United States Patent [19]

Holroyd

[11] Patent Number: 4,602,401

[45] Date of Patent: Jul. 29, 1986

[54] SQUEEGEE CONSTRUCTION

[76] Inventor: Wilbur R. Holroyd, 7456 N. 24th St., Kalamazoo, Mich. 49004

[21] Appl. No.: 673,801

[22] Filed: Nov. 21, 1984

[51] Int. Cl.[4] ..... A47L 1/06

[52] U.S. Cl. ..... 15/245; 15/144 R

[58] Field of Search ..... 15/245, 144 R, 401

[56] References Cited

U.S. PATENT DOCUMENTS

| | | | |
|---|---|---|---|
| 1,579,941 | 4/1926 | Jenkins | 15/245 |
| 1,720,630 | 7/1929 | Eiermann | 15/245 |
| 1,789,636 | 1/1931 | Oberti | 15/245 |
| 1,918,611 | 7/1933 | Oberti | 15/245 |
| 2,193,571 | 3/1940 | Siemund | 15/144 R |
| 2,610,351 | 9/1952 | Lilly | 15/401 |
| 3,119,138 | 1/1964 | Davis | 15/245 X |

*Primary Examiner*—Chris K. Moore

*Attorney, Agent, or Firm*—Flynn, Thiel, Boutell & Tanis

[57] ABSTRACT

A squeegee construction is disclosed which has an elongated handle, a V-shaped frame mounted at one end of the handle, and a continuous elongated squeegee blade secured to the frame. The squeegee blade extends lengthwise along substantially the entire length of the V-shaped frame, and thus assumes a V-shape geometrically similar to the V-shape of the frame. The squeegee blade extends below the lower edge of the frame, and the lower edge of the squeegee blade is substantially coplanar over the entire width of the squeegee construction. The squeegee of the present invention is highly useful for spreading a liquid filling material into cracks in surfaces such as roofs, asphalt cement roads and driveways.

6 Claims, 5 Drawing Figures

SQUEEGEE CONSTRUCTION

FIELD OF THE INVENTION

This invention relates to a squeegee construction adapted for filling cracks in a surface with a fluid filling material. In particular, the squeegee device of the present invention is a manual tool useful for spreading a bituminous crack filler into cracks on rooftops, asphalt cement roads, parking lots, driveways and the like.

BACKGROUND OF THE INVENTION

Squeegees have been in common use for a long time, and a wide variety of squeegee designs are known. Squeegees are used for spreading, pushing or wiping a liquid or fluent material on, across or off of a surface, and are most commonly used for wiping cleaning fluid off of windows. Conventional squeegees generally comprise a flexible blade made of leather or rubber set on a handle. In some designs, the blade is mounted on a frame member, and the frame member is secured to the handle.

Specific squeegee designs have been extensively patented. The following U.S. patents pertain to squeegee constructions and features thereof: U.S. Pat. Nos. 448,758, 548,892, 834,667, 909,793, 952,309, 1,139,834, 1,586,439, 1,897,726, 2,008,615, 2,770,826, 2,904,806, 3,368,230, 3,787,921, 4,409,700 and 28,990 (Design). In particular, the foregoing U.S. Pat. Nos. 448,758, 834,667, 1,139,834, 1,586,439, 2,770,826, 2,904,806, 3,787,921, 4,409,700 and 28,990 (Design) disclose squeegee constructions containing substantially V-shaped frame members. However, most of these patents are concerned with devices for cleaning windows which include a handle, a V-shaped frame mounted on the end of the handle, and cleaning elements such as sponges or squeegees mounted on the free ends of the legs of the V-shaped frame.

It is an object of the present invention to provide a squeegee construction specifically adapted for effectively directing a liquid or fluid filling material into cracks in a surface, such as a roof.

It is a further object of the invention to provide a squeegee construction which effectively channels filling material spread over a wide area of the surface into a crack in the surface.

It is an additional object of the present invention to provide a squeegee construction as aforesaid wherein the handle can be secured in different positions relative to the frame, or the handle can be pivotally connected to the frame.

Other objects and purposes of the invention will be apparent to persons acquainted with devices of this type upon reading the following specification and inspecting the accompanying drawings.

Figure 5:
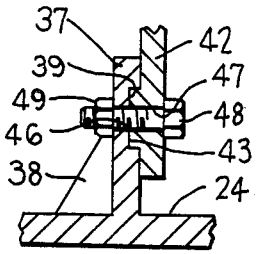
FIG. 5 is a sectional view taken along the line V—V in FIG. 1.

Certain terminology will be used in the following description for convenience in reference only and will not be limiting. For example, the words "upper" and "lower" will refer to directions in the drawings to which reference is made.

SUMMARY OF THE INVENTION

This invention relates to a squeegee construction wherein a rigid, substantially V-shaped frame is attached, at a location close to the apex thereof, to one end of an elongated handle so that the handle extends upwardly therefrom. The frame has a central juncture portion and a pair of legs which diverge laterally from the juncture portion. A continuous, elongated, flexible squeegee blade member is secured to the frame so that the squeegee blade member projects downwardly therefrom and extends lengthwise along substantially the entire length of both of the legs, and also extends across the juncture portion. The squeegee blade member is substantially V-shaped in plan view, like the frame. The squeegee blade member has an upper portion which is secured to the frame, and a lower portion which extends below the frame so that this lower portion can flex as needed during use. An important feature of the invention is that the entire lower edge of the squeegee blade member lies substantially in a common plane over the entire width of the squeegee construction. By this means, a liquid filling material can be effectively channeled towards the center or apex of the squeegee, so that if the squeegee construction of the invention is centered on and pushed over a crack in a surface, the filling material will be channeled toward and into the crack by the V-shaped squeegee blade member.

DETAILED DESCRIPTION

Figure 1:
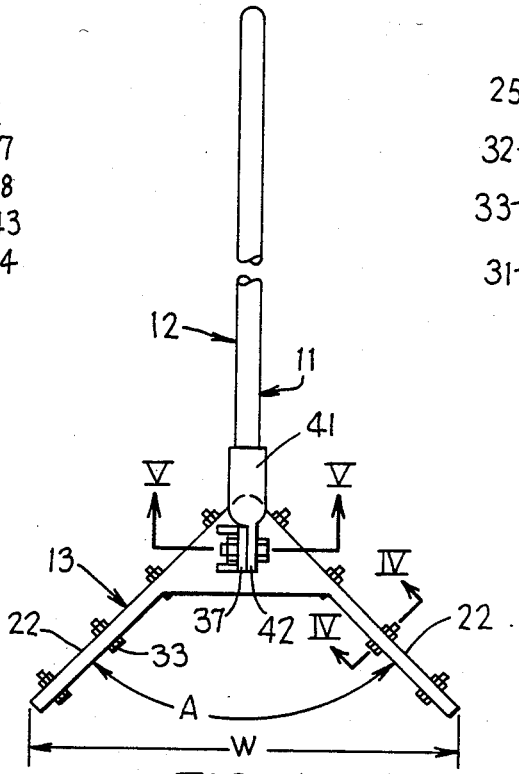
FIG. 1 is a top plan view of a squeegee construction according to the present invention.

Referring to the drawings, FIG. 1 shows a squeegee construction 11 according to the present invention comprising a handle 12 mounted at one end thereof to a rigid frame 13 which is substantially V-shaped in plan view. The handle 12 is preferably mounted, as shown, so that it bisects the included angle A defined by the V-shaped frame 13 and extends upwardly from said frame. The handle 12 typically comprises a wooden rod several feet in length, as is conventional with hand tools of this type.

Figure 2:
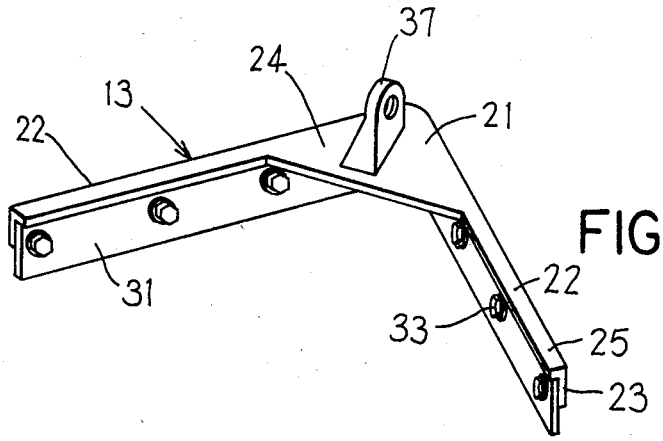
FIG. 2 is a perspective view of a squeegee frame and squeegee blade assembly used in the embodiment shown in FIG. 1.
Figure 3:
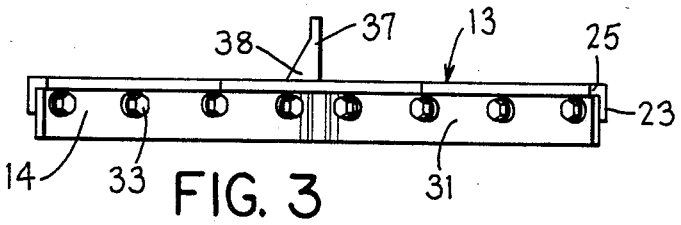
FIG. 3 is an end view of the squeegee frame and blade assembly shown in FIG. 2.

FIGS. 2 and 3 show the structure of the frame 13. The frame 13 comprises a central juncture portion 21 and a pair of laterally diverging legs 22 which are integral therewith. For example, the frame 13 can be made of a one-piece casting. Both of the legs 22 of the frame 13 are of inverted, substantially L-shaped cross section and comprise an upright wall 23 and a laterally inwardly extending flange 25 at the upper end of the wall 23. In the central juncture portion 21 of the frame 13, the flanges 25 are extended and joined to each other to form a flat mounting plate portion 24 which is substantially triangular in plan view. According to this construction, the juncture portion 21 of the frame 13 is comprised of the plate portion 24 and the central portion of the wall 23. The legs 22 each comprise opposing laterally outer portions of the walls 23 and flanges 25 which diverge from the central juncture portion 21.

A squeegee blade member 31 is secured to the inside of the frame 13 so that an upper edge 32 of the blade member 31 contacts or is in close proximity with the underside of the flange 25. The blade member 31 extends downwardly along the inner surface of wall 23 and thence downwardly below the lower edge of wall 23. The blade member 31 comprises a flat strip which is rectangular in cross section and is made of an elastomer. This flat strip is bent once along the length thereof so that the squeegee blade member 31 assumes a substantial V-shape in plan view and is substantially geometrically similar to the V-shaped frame in plan view. A plurality of fasteners 33, for example, a nut and bolt, penetrate through the blade member 31 and lateral through-holes 34 in the wall 23 to releasably secure the blade member 31 to the frame 13. In the embodiment shown, the blade 31 is secured by eight such fasteners 33 mounted at intervals along the wall 23 of the frame 13. The entirety of the lower edge of the blade member 31 substantially lies on an imaginary common plane so that said lower edge will be effective to squeegee material along a flat surface. The lower portion of the blade member 31 can flex as necessary to provide an effective squeegeeing action.

Figure 4:
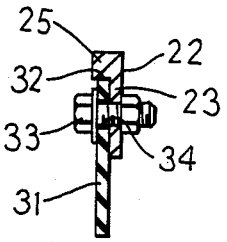
FIG. 4 is a sectional view taken along the line IV—IV in FIG. 1.

As shown in FIG. 4, the blade member 31 is clamped by the fastener 33 against the inner side surface of the wall 23. The flange 25 extends over the top edge of the blade 31 to protect the blade 31 from above.

As shown in FIGS. 1, 2 and 5, the plate portion 24 has an upright mounting flange or ear 37 formed at or near the center of the frame in the lateral direction thereof. In the embodiment shown, the flange 37 has a pair of upwardly tapering reinforcing gussets 38 formed at opposite sides thereof. The side face of the upright flange 37 opposite the reinforcing portions 38 has a cylindrical recess 39 formed therein. The wooden shaft of the handle 12 has a fitting 41 mounted thereon, which fitting 41 includes a flattened tip portion 42. The tip portion 42 has a cylindrical boss 43 formed on one side face thereof, which cylindrical boss 43 is received in and mates with the cylindrical recess 39 in the upright flange 37, as shown in FIG. 5. The diameter of the cylindrical boss 43 is slightly smaller than the diameter of the cylindrical recess so that the handle 12 can pivot relative to the frame 13. The upright flange 37 and tip portion 42 have coaxially aligned through-holes 46 and 47 respectively extending therethrough. A bolt 48 is inserted through the through-holes 46, 47 and secured therein by a nut 49. By this means, the handle 12 is releasably attached to the frame 13. The handle 12 can be locked to the frame 13 by tightening the nut. The handle 12 can be adjusted by loosening the nut.

The frame 13 is preferably made of a light metal, such as cast aluminum. The blade member 31 is generally made of an elastomeric material, such as rubber. The included angle A defined by the legs 22, as shown in FIG. 1, is preferably about 90°. However, this angle can be varied as necessary, and a range of 60°–120°, particularly 80°–100°, is preferred for the angle A. The frame 13 can be of any size, but preferably has a width W as indicated in FIG. 1 in the range of 0.5 to 4 feet, particularly 1 to 3 feet, most preferably 14 to 24 inches. The lateral ends of the blade member 31 may be substantially flush with the lateral ends of the legs 22, or may extend slightly beyond the ends of the legs 22. The blade member 31 preferably extends 0.5 to 1.0 inches below the lower end of the frame 13, and the lower edge of the blade member 31 is coplanar so that the filling material will be channeled toward the center of the V-shaped frame when the squeegee is moved along the surface. The handle 12 is preferably 1–10 feet in length, particularly 4–7 feet in length, so that the squeegee construction of the present invention can be readily wielded by one person. The remaining dimensions of the squeegee according to the invention are proportional, as indicated by the drawings, to the measured dimensions discussed above.

Although a particular preferred embodiment of the invention has been disclosed in detail for illustrative purposes, it will be recognized that variations or modifications of the disclosed construction, including the rearrangement of parts, lie within the scope of the present invention.

The embodiments of the invention in which an exclusive property or privilege is claimed are defined as follows:

1. A squeegee construction, comprising:

an elongated handle;

a rigid V-shaped frame mounted at one end of said handle, said frame having a central juncture portion and a pair of legs which diverge laterally from said juncture portion, said central juncture portion having an upper mounting wall to which said handle is attached and said legs having downwardly extending walls extending below said upper mounting wall; and a continuous, elongated, flexible squeegee blade member secured to said frame, said squeegee blade member extending lengthwise along substantially the entire length of both of said legs and extending across said juncture portion, said squeegee blade member having an upper portion which is secured to said downwardly extending walls and a lower portion which extends below said frame, said lower portion having a lower edge which is substantially coplanar over the entire width of said squeegee construction.

2. A squeegee construction as claimed in claim 1, wherein said upper mounting wall is substantially horizontal and triangular, and has an upright flange formed on an upper face thereof, said handle being secured to said upright flange.

3. A squeegee construction as claimed in claim 1, wherein said squeegee blade member comprises a flat, elastomeric strip rectangular in cross section which is bent once along its length so that said squeegee blade member is deformed to a V-shape which is substantially geometrically similar to the shape of said V-shaped frame.

4. A squeegee construction as claimed in claim 3, wherein respective opposite end portions of said strip comprising said squeegee member extend parallel with said legs of said frame over the entire length of each of said legs.

5. A squeegee construction as claimed in claim 2, wherein said upright flange has a cylindrical recess in a side face thereof and a lateral through-hole therein which is coaxial with and of smaller diameter than said cylindrical recess, said one end of said handle has a cylindrical boss formed on one side thereof, which cylindrical boss is in mating engagement with said cylindrical recess, and said one end of said handle further has a lateral through-hole therein coaxial with said cylindrical boss, and a fastener is inserted through said through-holes to secure said frame to said handle.

6. A squeegee construction as claimed in claim 1, wherein each of said downwardly extending walls of said legs has a laterally inwardly extending flange thereon at the upper end thereof, the upper faces of said laterally inwardly extending flanges being coplanar with the upper face of said upper mounting wall, and the upper edge of said squeegee member is in close proximity to the underside of each of said laterally inwardly extending flanges.

* * * * *